US009102503B2

(12) United States Patent
Schuler et al.

(10) Patent No.: US 9,102,503 B2
(45) Date of Patent: Aug. 11, 2015

(54) ELEVATOR CAGE FLOOR WITH FILLER

(75) Inventors: Christoph Schuler, Cham (CH); Beat Brügger, Lucerne (CH); Lukas Zeder, Huddinge (SE); René Strebel, Buttwil (CH); Thomas Wüest, Hochdorf (CH); Urs Schaffhauser, Root (CH)

(73) Assignee: Inventio AG, Hergiswil (CH)

( * ) Notice: Subject to any disclaimer, the term of this patent is extended or adjusted under 35 U.S.C. 154(b) by 571 days.

(21) Appl. No.: 13/334,782

(22) Filed: Dec. 22, 2011

(65) Prior Publication Data

US 2012/0160614 A1 Jun. 28, 2012

(30) Foreign Application Priority Data

Dec. 22, 2010 (EP) ..... 10196372

(51) Int. Cl.
*B66B 11/02* (2006.01)

(52) U.S. Cl.
CPC ..... *B66B 11/0226* (2013.01); *Y10T 29/49993* (2015.01)

(58) Field of Classification Search
CPC ..... B66B 11/0226; B66B 11/02
USPC ..... 187/401
See application file for complete search history.

(56) References Cited

U.S. PATENT DOCUMENTS

| | | | | |
|---|---|---|---|---|
| 3,815,215 | A * | 6/1974 | Medawar | 29/460 |
| 4,594,281 | A * | 6/1986 | Haraga et al. | 428/172 |
| 5,309,690 | A * | 5/1994 | Symons | 52/309.9 |
| 2007/0101679 | A1 * | 5/2007 | Harthcock et al. | 52/782.1 |
| 2011/0147358 | A1 * | 6/2011 | Kober et al. | 219/202 |
| 2012/0231233 | A1 * | 9/2012 | Kanao | 428/195.1 |
| 2012/0255811 | A1 * | 10/2012 | Wuest et al. | 187/343 |

FOREIGN PATENT DOCUMENTS

| | | | |
|---|---|---|---|
| CN | 2740579 | Y | 11/2005 |
| EP | 0566424 | A1 | 10/1993 |
| EP | 0700860 | A1 | 3/1996 |
| EP | 0566424 | B1 | 2/1997 |
| EP | 1004538 | A1 | 5/2000 |
| EP | 1004538 | B1 | 2/2004 |
| JP | 6115859 | A | 4/1994 |
| JP | 2007091426 | A | 4/2007 |
| JP | 2010228880 | A | 10/2010 |
| WO | 2004083096 | A1 | 9/2004 |

* cited by examiner

*Primary Examiner* — Sang Kim
*Assistant Examiner* — Diem Tran
(74) *Attorney, Agent, or Firm* — Fraser Clemens Martin & Miller LLC; William J. Clemens

(57) ABSTRACT

An elevator cage floor has a composite-structure or sandwich mode of construction, including at least one base plate, at least one top plate and at least one composite-structure core disposed therebetween and having at least two chambers, wherein the composite-structure core is connected with the base plate and the top plate. At least one of the at least two chambers of the composite-structure core is at least partly filled with a defined amount of a filler.

18 Claims, 3 Drawing Sheets

ELEVATOR CAGE FLOOR WITH FILLER

CROSS-REFERENCE TO RELATED APPLICATION

This application claims priority to European Patent Application No. 10196372.6, filed Dec. 22, 2010, which is incorporated herein by reference.

FIELD

The disclosure relates to an elevator cage floor.

BACKGROUND

An elevator cage is usually guided on vertically extending guide rails. In that case it can be important that the sliding guidance or rolling guidance shoes, which are arranged at the elevator cage and guide the elevator cage along the guide rails, do not, as far as is possible, cant relative to the guide rails. By canting there is meant in this context that the elevator cage is inclined in the horizontal relative to the guide rails due to a non-uniform weight distribution and a displacement, which is connected therewith, of the center of gravity of the elevator cage in the horizontal, thus the elevator cage or the cage floor is not arranged perpendicularly or almost perpendicularly to the guide rails. The sliding guidance or rolling guidance shoes are thereby subjected to increased friction, which can lead on the one hand to more wear and on the other hand to greater energy consumption. Compensation for the non-uniform weight distribution of the elevator cage is usually provided by compensating weights arranged at the underside of the elevator cage or in the elevator cage frame.

Elevator cage floors with a composite structure are frequently used in elevator construction. An elevator cage floor of that kind has, inter alia, the function of accepting the weight of the cage superstructure with walls, cage roof, cage doors and diverse fixtures as well as the total maximum rated load and conducting the weight into the cage frame, usually by way of suitable vibration insulating elements. In that case it can be important that the entire floor does not deform beyond certain limits even under eccentric loading, i.e. does not warp or twist. It is equally important that it cannot be excited into impermissibly strong natural bending oscillations due to disturbing oscillations such as are primarily transmitted to the cage from the drive by way of the support cables. This can be achieved by a high degree of bending stiffness of the floor in all directions with a highest possible bending natural frequency resulting therefrom. A further demand on such an elevator cage floor is that its surface, which is usually formed by a steel plate, does not suffer permanent deformations under high loads concentrated on small areas (for example, due to transport equipment with relatively small wheels). Standards of certain European countries additionally prescribe that elevator cages must contain only minimum amounts of materials which are not classified as 'non-combustible'.

EP 0 566 424 B1 describes a construction of an elevator cage floor in which the requisite characteristics are to be achieved by use of a composite-structure principle (sandwich principle). In that case, a core of wood, cardboard or thermoplastic foam is glued in place substantially between an upper top plate constructed as a composite layer and an equivalent lower base plate. In order to achieve sufficient strength of the top plate, which forms the cage floor surface, relative to loads concentrated on small areas, support webs are inserted between strips of the core material. In order that cage parts such as, for example, cage walls or door thresholds connected with this floor can be fixed in place the described composite-structure plate is enclosed by a steel frame.

EP 1004538 B1 describes a cage floor for passenger or goods elevators in composite-structure or sandwich mode of construction, which as core contains a structure, which is similar to a grating, of intersecting longitudinal and transverse slats firmly connected with the base plate and the top plate. Such a cage floor is stiff in bending and torsion and has a high bending natural frequency. If the cage floor consists of steel, then the elements of the composite structure can be connected together by slot welding.

Due to the fact that the mass of an elevator cage floor with a composite-structure core is low as a consequence of the mode of construction, it can happen that the friction at the drive pulley in the drive-pulley elevators is too small and twisting of the support means at the drive pulley thereby arises. In order to counteract that, the elevator cage is frequently weighted with appropriate weights at the underside of the elevator cage or in the elevator cage frame. In order that these weights can be mounted on the underside of the elevator cage, an additional frame or an additional component is frequently necessary.

SUMMARY

Various embodiments comprise an elevator cage floor in composite-structure or sandwich mode of construction, comprising at least one base plate, at least one top plate and at least one composite-structure core lying therebetween and having at least two chambers, at least one of the at least two chambers of the composite-structure core is at least partly filled with a defined amount of a filler, whereas at least two chambers of the composite-structure core are differently filled. The composite-structure core is connected with the base plate and the top plate, thus, for example, glued, welded, welded by slot welding, screw-connected, thermoplastically connected, etc.

In some embodiments, the composite-structure core forming the connection between base plate and top plate can comprise a number of intersecting slats, which stand on edge, in the form of a grating. The grating interstices, thus the cavities, are termed chambers. Obviously, depending on the mode of construction of the composite-structure core other, for example, irregularly or regularly shaped cavities or chambers could also arise in the composite-structure core.

The slats of the grating can, for example, be fixedly connected at the intersection points with the base plate and the top plate by slot welding.

The intersection of the slats lying at the same level is made possible in that these slats at all intersection points are provided with slots which are punched or shaped at right angles to the slat longitudinal axis and the width of which corresponds with the slats approximately in the material thickness. In that case the slots extend from above in the case of the slats running in one direction and from below in the case of the slats running at right angles thereto and in each instance extend to approximately half the slat height.

The side walls of the cage floor can be produced by bending, deep-drawing, etc., of the base plate or top plate. However, it is also conceivable for the side parts of the cage floor to be separate and suitably connected with the base plate, the composite-structure core and/or the top plate, for example by welding, gluing, screw-connecting, etc.

As filler, use can be made of the most diverse materials suitable for weighting the elevator cage. Thus, cement, rubble, stones, liquids, oils, metal bodies and, particularly, lead bodies, etc., are conceivable. In that case the filler can be embedded in an embedding material such as, for example, a silicon, gel, rubber, cement, plastics material, etc. Thus, for example, undesired movements of the filler can be prevented.

In some embodiments the base plate and/or top plate can have at least one opening for introduction or filling or for emptying of the filler and/or the embedding material. The at least one opening can be as desired with respect to its shape and dimensions. The at least one opening could, for example, also arise in that the base plate and/or the top plate is or are removed and thus the at least two chambers of the composite-structure core are exposed.

The filler and/or the embedding material can be filled or introduced into or removed or emptied from the at least one of the at least two chambers of the composite-structure core of the elevator cage floor during production of the elevator cage, during assembly of the elevator installation and/or within the scope of maintenance of the elevator installation.

In additional embodiments, the elevator cage can be at least partly weighted in simple mode and manner without additional constructional measures. No extra beams, components, frames or similar have to be mounted on the elevator cage so that the elevator cage can be weighted or balanced by means of weights.

In at least some cases, an at least partial compensation for displacement of the center of gravity of the elevator cage in the horizontal can be efficiently provided in that only individual chambers are filled with the filler.

BRIEF DESCRIPTION OF THE DRAWINGS

The disclosed technologies are explained in more detail on the basis of an exemplifying embodiment illustrated in the figures, in which.

DETAILED DESCRIPTION

Figure 1:
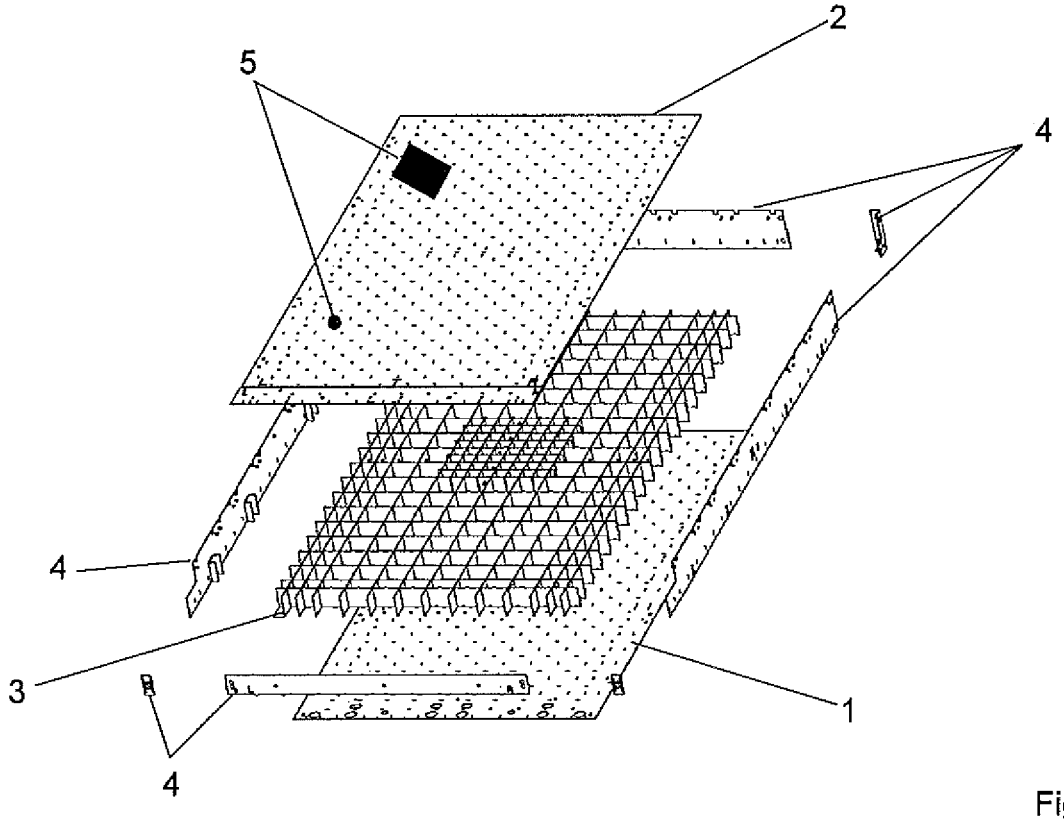
FIG. 1 shows an example of an elevator cage floor.

FIG. 1 shows an exemplary embodiment of an elevator cage floor with a base plate 1, a top plate 2, a composite-structure core 3 disposed between base plate 1 and top plate 2, and side parts 4. The composite-structure core 3 can comprise a grid structure or any other structure such as, for example, a honeycomb structure, a non-uniform grid structure, etc. In the present example the composite-structure core 3 has a grid structure. This grid structure can have zones with special strength, for example in the center or at the edges of the cage floor. By virtue of the grid structure of the composite-structure core, cavities or chambers, which have different volumes, can arise. The chambers or the honeycombs in that case have, for example a spacing of 100 to 150 millimeters, wherein this spacing can be selected to be greater or smaller in dependence on, inter alia, the requirements with respect to bending stiffness.

The base plate 1, top plate 2, composite-structure core 3 and side parts 4 are connected with one another in ideal manner. This connection can be produced by, for example, welding, gluing, screw-connecting, etc.

The base plate 1, top plate 2—as in this example—and/or the side parts 4 can also have openings 5 by way of which a filler can be introduced or filled into the cavities or chambers of the composite-structure core. These openings 5 can be, for example, bores, flaps, covers, etc., and of any number. After filling, these openings 5 can be closed in suitable manner. Thus, these openings could be closed, for example, by a cover, a screw closure, a plug, a lid, etc. In addition, the elevator cage floor can be emptied again by way of these openings 5.

Figure 2:
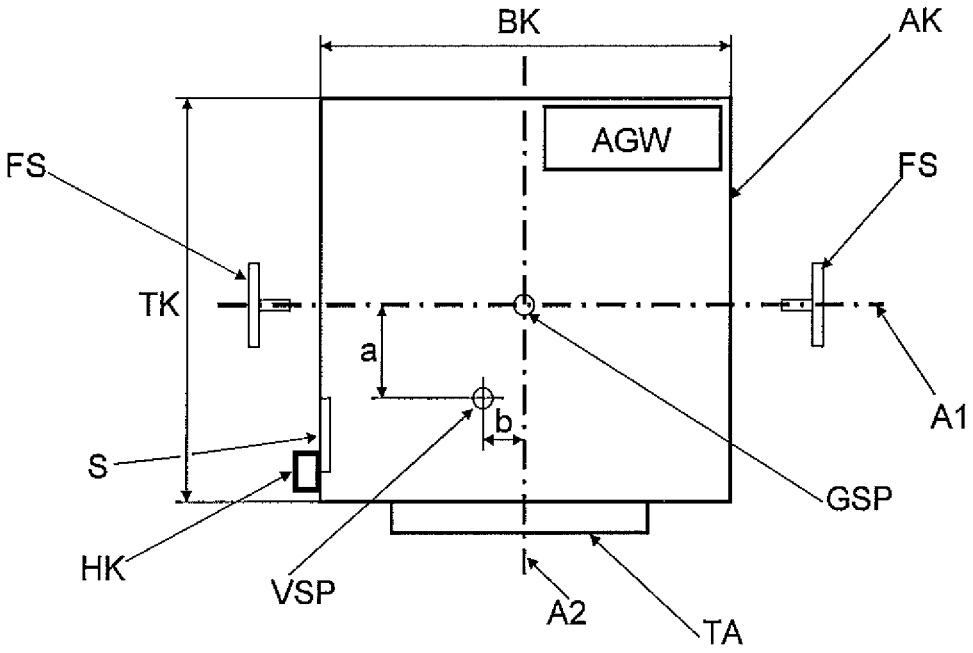
FIG. 2 shows an example for compensation for displacement of the center of gravity of the elevator cage in the horizontal.

FIG. 2 shows an example for compensation for a shift of the center of gravity of the elevator cage AK in the horizontal in the case of an arbitrary elevator installation, for example a drive-pulley elevator, a hydraulic elevator, an elevator without counterweight, etc. In the present figure the elevator cage AK is shown from above. The elevator cage AK has the width BK and the depth TK and is guided in guide rails FS by way of sliding guidance or rolling guidance shoes which, for reasons of clarity, are not illustrated. The elevator cage AK has a geometric center of gravity GSP. If, for example, the door drive TA, a mirror S, an eccentrically pulling hanging cable HK, etc., are arranged or mounted in or outside the elevator cage AK, the center of gravity of the elevator cage displaces in the horizontal, illustrated in this figure as shifted center of gravity VSP. This center of gravity VSP is determined in that it (VSP) is disposed at a spacing a from the center of gravity axis A1 and at a spacing b from the center of gravity axis A2 in the horizontal. The center of gravity axes A1, A2 extend through the geometric center of gravity GSP.

In order to provide at least partial compensation for the shift of the center of gravity VSP, in some embodiments a defined amount of a filler is introduced or filled into the elevator cage floor according to FIG. 1 as a compensating weight AGW and in such a way that the center of gravity VSP displaces in the horizontal. This can be carried out during production of the elevator cage floor or during assembly or during maintenance of the elevator installation. Through the compensating weight AGW the shifted center of gravity VSP is displaced in the direction of the geometric center of gravity GSP, wherein, for example, there can be selected for the spacing a from the center of gravity axis A1 for the rolling guidance shoe a <50 millimeters and for the sliding guidance shoe a <100 millimeters. Thus, for balancing the elevator cage the chambers of the composite-structure core have different filling levels.

The filler to be introduced into the composite-structure core 3 can be as desired. Thus, for example, use can be made of cement, rubble, one or more metal bodies, one or more lead bodies, stones, liquids such as, for example, water, oils, cutting detritus, etc. In order that the filler cannot move, this filler can, for example, be embedded in an embedding material. Embedding materials of that kind can similarly be as desired. Thus, for example, use can be made of cement, silicon, a gel, plastics material, rubber, etc. The filler or the embedding mass can, for example, be introduced or filled by way of the openings 5 with opened top plate 2, etc. In that case, individual or multiple chambers of the composite-structure core 3 are filled in such a manner that the shifted center of gravity VSP is displaced in the horizontal in the direction of the geometric center of gravity GSP.

Figure 3:
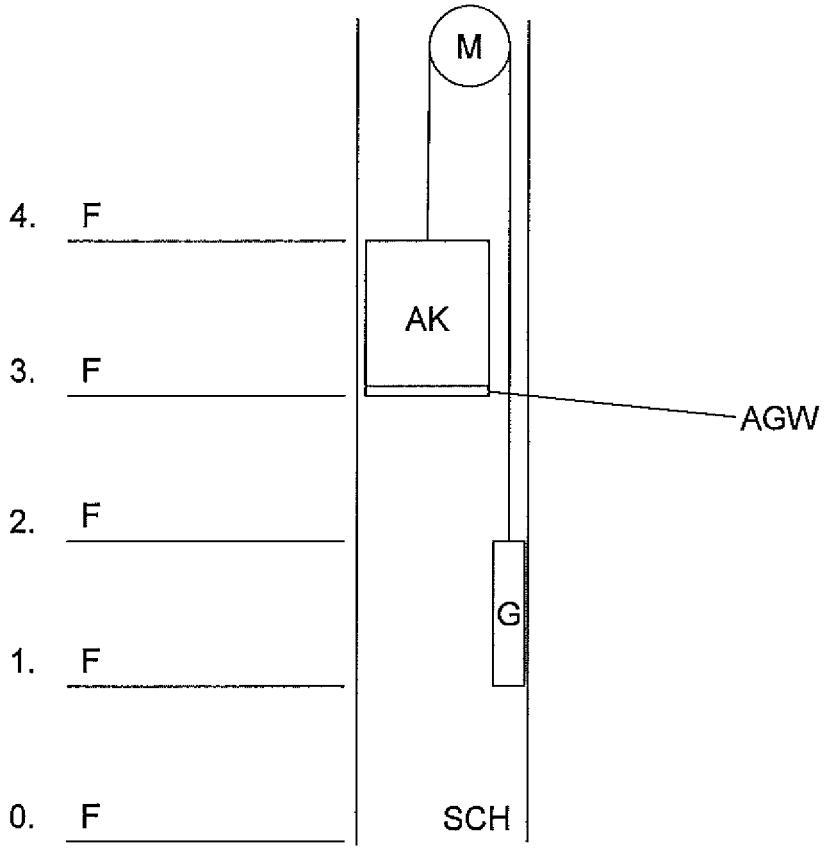
FIG. 3 shows a schematic illustration of an elevator installation with a weighted elevator cage.

FIG. 3 shows a schematic illustration of an exemplary embodiment of an elevator installation with a weighted elevator cage AK. An elevator installation with an elevator cage AK, which is moved vertically in a shaft SCH so that the stories 0. F to 4. F of a building can be served, is shown. For that purpose the elevator installation has a drive-pulley drive M. The elevator cage AK is connected with a counterweight G by way of support means, for example a cable, belt, wire cable, metal band, etc.

Particularly in the case of high conveying heights it can happen with drive-pulley elevators with a drive-pulley drive M that the support means has too little friction on the drive pulley of the drive-pulley drive M and twists. This is often due to the fact that the elevator cages AK are produced in a lightweight style of construction and thus have too small a mass.

In further embodiments, the elevator cage floor of the elevator cage is, as described in FIGS. 1 and 2, filled with a filler as compensating weight AGW so that the elevator cage AK has a higher mass. The friction of the drive pulley of the drive-pulley drive M can thereby be optimized.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An elevator cage floor, comprising:

at least one base plate;

at least one top plate; and at least one composite-structure core, the at least one composite-structure core being positioned between the at least one base plate and the at least one top plate, the at least one composite-structure core being connected with the at least one base plate and the at least one top plate and comprising at least two chambers, one of the at least two chambers containing a first amount of a filler and another of the at least two chambers being empty or containing a second amount of the filler having a weight less than a weight of the first amount of the filler, the first amount of the filler being at least one of a liquid material and a plurality of solid bodies, whereby when the elevator cage floor is assembled with an elevator cage the filler displaces a center of gravity of the elevator cage in a horizontal plane relative to a geometric center of gravity of the elevator cage.

2. The elevator cage floor of claim 1, the composite-structure core comprising a plurality of intersecting slats.

3. The elevator cage floor of claim 2, the plurality of intersecting slats being connected with the base plate by slot welding at intersecting points of the intersecting slats.

4. The elevator cage floor of claim 2, the plurality of intersecting slats being connected with the top plate by slot welding at intersecting points of the intersecting slats.

5. The elevator cage floor of claim 2, the plurality of intersecting slats interlocking with each other by slots.

6. The elevator cage floor of claim 2, further comprising side walls, the side walls being a single piece with the base plate.

7. The elevator cage floor of claim 2, further comprising side walls, the side walls being a single piece with the top plate.

8. The elevator cage floor of claim 1, the filler comprising one or more of cement, rubble, stones, liquid, oil and metal bodies.

9. The elevator cage floor of claim 1, the filler being embedded in an embedding material.

10. The elevator cage floor of claim 9, the embedding material comprising one or more of silicon, plastic, cement, rubber and gel.

11. The elevator cage floor of claim 1, the base plate or the top plate comprising an opening to at least one of the at least two chambers.

12. A method for weighting and balancing an elevator cage, comprising:

providing at the elevator cage an elevator cage floor having a composite-structure core connected between a base plate and a top plate;

introducing into a first chamber a first amount of a filler, the first chamber being in the composite-structure core between the top plate and the base plate of the elevator cage floor, the first amount of the filler being at least one of a liquid material and a plurality of solid bodies; and introducing into a second chamber a second amount of the filler, the second chamber being in the composite-structure core and the second amount being different than the first amount, whereby the filler displaces a center of gravity of the elevator cage in a horizontal plane relative to a geometric center of gravity of the elevator car.

13. The elevator cage method of claim 12, a center of gravity of the elevator cage being horizontally displaced by the filling of the first chamber or the filling of the second chamber.

14. The elevator cage method of claim 12, further comprising adding an embedding material to the first chamber or the second chamber.

15. The elevator cage method of claim 12, the method being performed during production of the elevator cage floor.

16. The elevator cage method of claim 12, the method being performed during assembly of an elevator installation.

17. The elevator cage method of claim 12, the method being performed during maintenance of an elevator installation.

18. An elevator installation, comprising:

an elevator cage, the elevator cage comprising an elevator cage floor, the elevator cage floor comprising, at least one base plate, at least one top plate, and at least one composite-structure core, the at least one composite-structure core being positioned between the at least one base plate and the at least one top plate, the at least one composite-structure core being connected with the at least one base plate and the at least one top plate and comprising at least two chambers, two of the at least two chambers containing different amounts of a filler whereby the filler displaces a center of gravity of the elevator cage in a horizontal plane relative to a geometric center of gravity of the elevator cage, the filler being at least one of a liquid material and a plurality of solid bodies.

* * * * *